US007300360B2

(12) United States Patent
Oyama

(10) Patent No.: US 7,300,360 B2
(45) Date of Patent: Nov. 27, 2007

(54) GOLF CLUB

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/478,648

(22) Filed: Jul. 3, 2006

(65) Prior Publication Data

US 2007/0049398 A1 Mar. 1, 2007

(30) Foreign Application Priority Data

Aug. 31, 2005 (JP) ..... 2005-252006

(51) Int. Cl.
*A63B 53/04* (2006.01)
*A63B 53/10* (2006.01)

(52) U.S. Cl. ..... 473/314; 473/316; 473/345; 473/349

(58) Field of Classification Search ..... 473/316–323, 473/314, 345, 349
See application file for complete search history.

(56) References Cited

U.S. PATENT DOCUMENTS 5,439,219 A * 8/1995 Vincent ..... 473/319

FOREIGN PATENT DOCUMENTS

| | | | |
|---|---|---|---|
| JP | 09-038254 | * | 10/1997 |
| JP | 3-251269 | * | 11/1998 |
| JP | 11-123255 | A | 5/1999 |
| JP | 2002-360746 | A | 12/2002 |
| JP | 2005-130935 | * | 5/2005 |

* cited by examiner

*Primary Examiner*—Stephen Blau
(74) *Attorney, Agent, or Firm*—Birch, Stewart, Kolasch & Birch, LLP

(57) ABSTRACT

A reference state is envisioned in which a golf club is placed on a horizontal plane P with a predetermined lie angle and face angle, and the shaft axis line thereof is disposed within a reference plane that is perpendicular to the horizontal plane P. A center of gravity of the head G is positioned on the back side of the head from the reference plane, and a depth of the center of gravity D that is a distance between the reference plane and the center of gravity of the head G is 20 mm or greater and 30 mm or less. The golf club has a flexural rigidity value EIt (kgf·mm$^2$) of the shaft at a position T3 140 mm away from the tip on the head side being $0.5\times10^6$ or greater and $1.75\times10^6$ or less. More preferably, a value of a ratio (GIt/EIt) of the flexural rigidity value EIt to a torsional rigidity value GIt of the shaft at a position 140 mm away from the tip on the head side is specified to be $0.8\times10^{-2}$ or greater and $1.2\times10^{-2}$ or less.

1 Claim, 8 Drawing Sheets

GOLF CLUB

This application claims priority on Patent Application No. 2005-252006 filed in JAPAN on Aug. 31, 2005, the entire contents of which are hereby incorporated by reference.

BACKGROUND OF THE INVENTION

1. Field of the Invention

The present invention relates to a golf club which can result in increase of the travel distance.

2. Description of the Related Art

Travel distance of golf balls attained through hitting with a golf club is principally determined by initial conditions of the ball. The initial conditions of the ball include initial ball speed, launch angle and spin rate upon hitting. Even though the initial ball speed is constant, the travel distance is increased through optimizing the launch angle and spin rate. In general, it has been known that greater launch angle and lower back spin rate can increase the travel distance.

JP-A No. H11-123255 discloses a technique developed in an attempt to achieve a great launch angle and low back spin rate by increasing the deflection angle of the shaft as measured under a given condition. JP-A No. 2002-360746 discloses a golf club which can result in increase of the travel distance by optimizing the amount of deflection of the entire shaft (forward shaft flex and backward shaft flex), and the depth of the center of gravity and the height of sweet spot of the head.

SUMMARY OF THE INVENTION

In evaluation of shaft characteristics defined for golf clubs described in JP-A Nos. H11-123255 and 2002-360746, amount of deflection of the entire shaft (amount of static deflection) is employed. The amount of deflection of the entire shaft determines so called shaft flex. When the shaft flex is defined to fall within a given range, the shaft flex would not be appropriate for golf players who hit with a head speed that does not fall within such a range of the flex. When a club with inappropriate shaft flex is used, the travel distance may be reduced, or the directional stability may be deteriorated.

An object of the present invention is to provide a golf club which can result in increase of the travel distance attained by a variety of golf players.

According to the golf club of the present invention, in a reference state in which the golf club is placed on a horizontal plane with a predetermined lie angle and face angle, and the shaft axis line thereof is disposed within a reference plane that is perpendicular to the horizontal plane, the golf club has: a center of gravity of the head being positioned on the back side of the head from the reference plane, and a depth of the center of gravity that is a distance between the reference plane and the center of gravity of the head being 20 mm or greater and 30 mm or less; and a flexural rigidity value EIt (kgf·mm$^2$) of the shaft at a position 140 mm away from the tip on the head side being $0.5\times10^6$ or greater and $1.75\times10^6$ or less.

Preferably, this golf club has a value of (GIt/EIt) being $0.8\times10^{-2}$ or greater and $1.2\times10^{-2}$ or less as determined when the torsional rigidity value of the shaft at a position 140 mm away from the tip on the head side is defined as GIt (kgf · mm$^2$).

According to the golf club of the present invention, the position of the center of gravity and the flexural rigidity in the vicinity of the shaft tip were specified to fall within an appropriate range, therefore, the head trajectory of an upper blow is apt to be attained, and the directional stability is secured. This golf club enables a golf club to be obtained which can result in increase of the travel distance.

DESCRIPTION OF THE PREFERRED EMBODIMENTS

Figure 1:
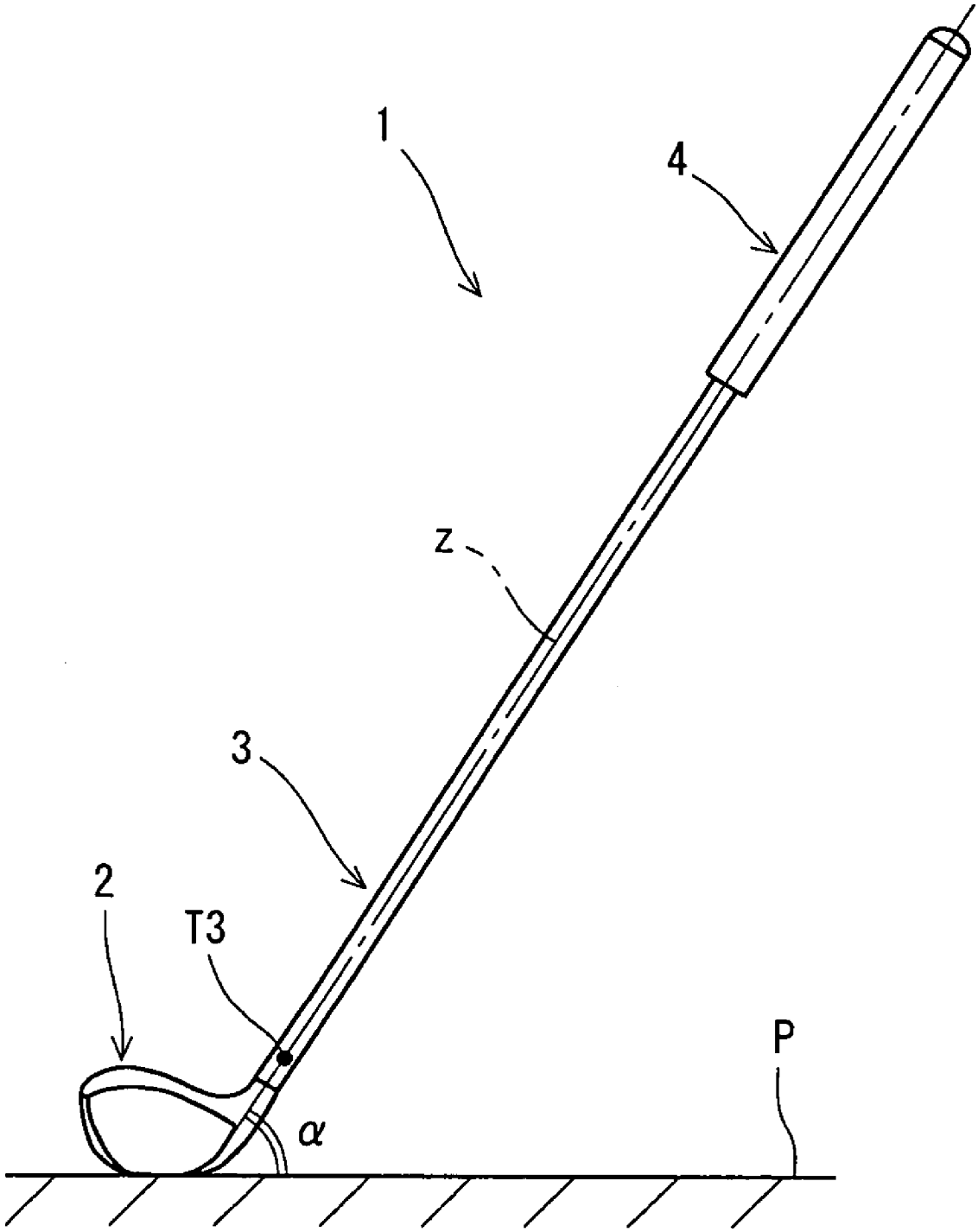
FIG. 1 is an overall view illustrating a golf club according to one embodiment of the present invention.
Figure 2:
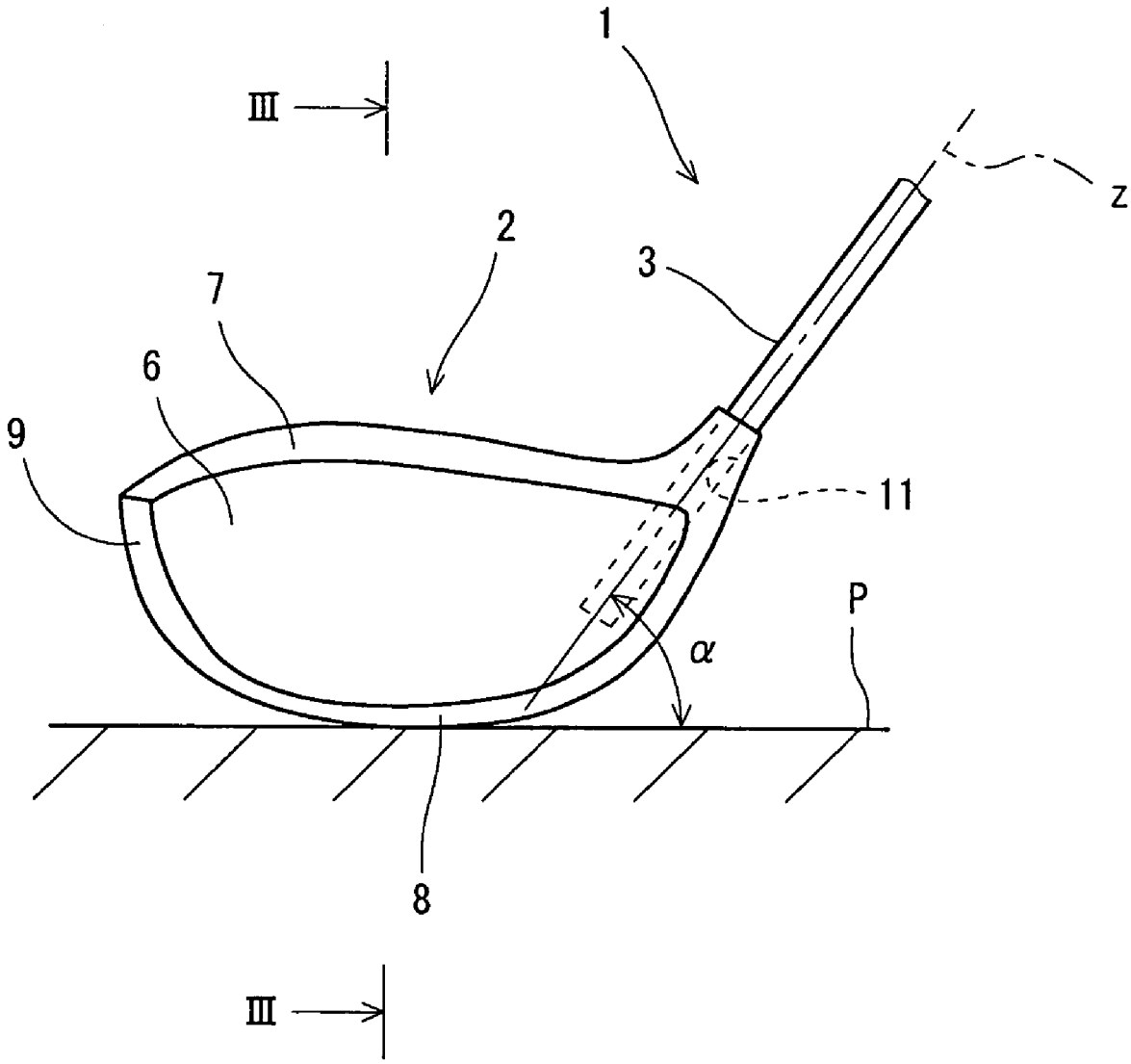
FIG. 2 is an enlarged view illustrating the vicinity of the head shown in FIG. 1.

Hereinafter, the present invention will be explained in detail by way of preferred embodiments with appropriate reference to the accompanying drawings.

A golf club 1 has a golf club head 2, a shaft 3, and a grip 4. The golf club head 2 is provided at one end (tip side) of the shaft 3. The grip 4 is provided at another end (butt side) of the shaft 3. The head 2 is a type of a wood golf club head. The shaft 3 is made of CFRP (carbon fiber reinforced plastic).

The head 2 has a face portion 6 that is brought into contact with the ball upon hitting, a crown portion 7 that extends from the upper margin of the face portion 6 toward the backside of the head and constitutes the upper surface of the head, a sole portion 8 that extends from the inferior margin of the face portion 6 toward the backside of the head and constitutes the inferior surface of the head, and a side portion 9 that extends between the crown portion 7 and the sole portion 8. A shaft hole 11 for inserting and attaching the shaft 3 is provided on the heel side of the head 2. The tip of the shaft 3 on the side of the head 2 is attached to the inner surface of the shaft hole 11 while being inserted in the shaft hole 11. Outer surface of the face portion 6, i.e., a face surface, is a curved face, and has a face bulge and a face roll.

Figure 3:
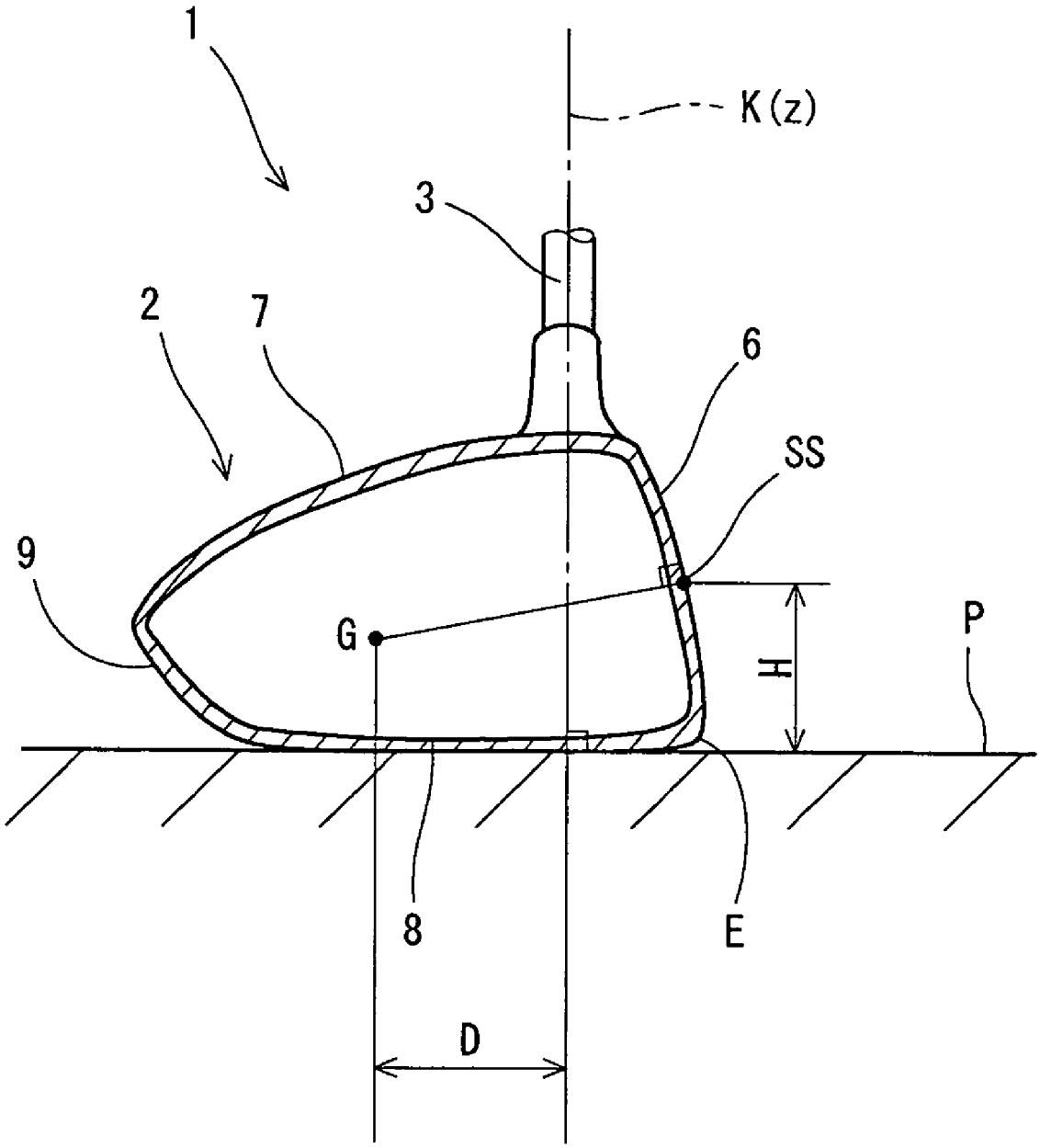
FIG. 3 is a cross-sectional view taken along a line III-III of FIG. 2.

As shown in FIG. 3, inside of the head 2 is hollow. The center of gravity of the head G of the head 2 is positioned at the hollow part in the head.

In the present invention, position of the center of gravity of the head G is specified. In order to specify the position of the center of gravity of the head G, a reference state is defined. The reference state is a state in which the golf club 1 is placed on a horizontal plane P with a predetermined lie angle $\alpha$ and face angle, and the shaft axis line z thereof is disposed in a reference plane K (depicted by the same line as the shaft axis line z in FIG. 3) that is perpendicular to the horizontal plane P.

The face angle is also referred to as a hook angle, and represents the direction of the face surface at the face center. By rotating the shaft while fixing the shaft axis line z, the face angle can be regulated to a desired value.

As shown in FIG. 3, the center of gravity of the head G is located at the head posterior to the reference plane K (at the back side to the reference plane K). In the golf club 1, a distance D between the center of gravity of the head G and the reference plane K is specified to be 20 mm or greater and 30 mm or less. The distance D is the length of a perpendicular line drawn from the center of gravity of the head G to the reference plane K. The distance D corresponds to the depth of the center of gravity D.

Figure 4:
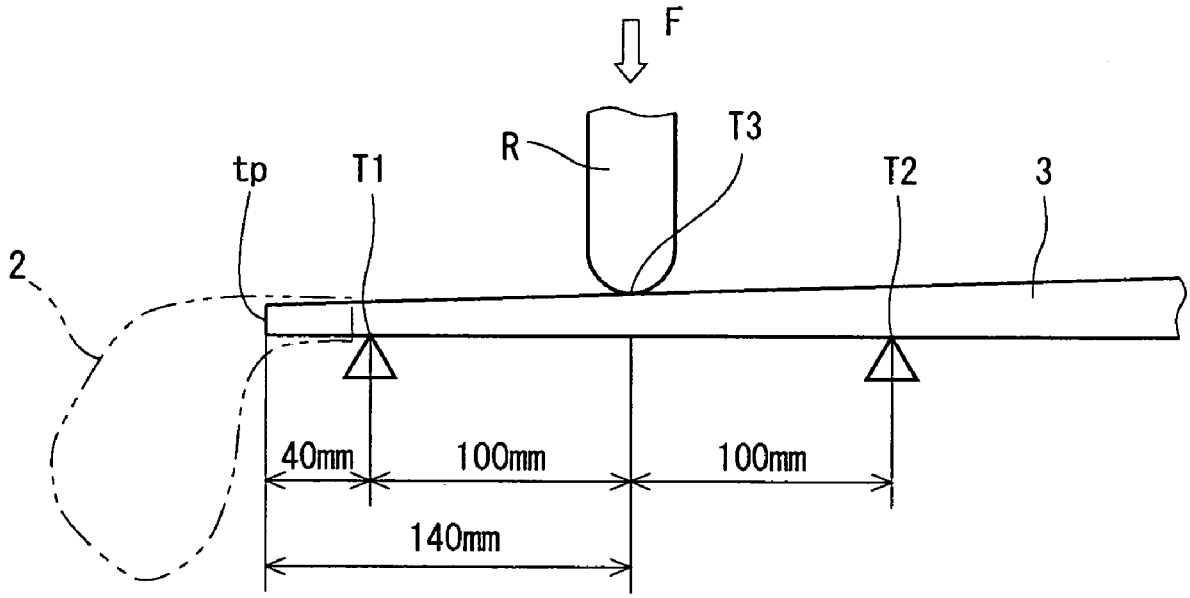
FIG. 4 is a diagram illustrating the mode of measurement of the flexural rigidity value EIt.

FIG. 4 shows a method of the measurement of the flexural rigidity value EIt. In the shaft 3, the flexural rigidity value EIt (kgf·mm$^2$) of the shaft at a position 140 mm away from the tip on the head side tp is specified to be $0.5\times10^6$ or greater and $1.75\times10^6$ or less. The flexural rigidity value EIt is measured using a universal material testing machine manufactured by INTESCO Co., Ltd., Type 2020 (maximum load being 500 kg). As shown in FIG. 4, the amount of deflection at a measurement point T3 140 mm away from the tip on the head side tp when a load F is applied to the point T3 from above is measured in a state in which a support point T1 40 mm away from the tip on the head side tp, and a support point T2 240 mm away from the tip on the head side tp are supported at each point from beneath. In the golf club 1, the tip on the head side tp is positioned inside of the shaft hole 11. When the head 2 shall be an obstruction to the measurement, the measurement may be carried out after taking off the head 2 from the shaft 3. The load F is imparted with an indentor R. The tip of the indentor R has a curved face with a curvature radius of 3 mm. Moving speed of the indentor R downward is specified to be 5 mm/sec. When the load F reaches 20 kgf (196 N), the movement of the indentor R is terminated, and the amount of deflection H (amount of displacement of the point T3 in upward or downward direction) then is measured. The flexural rigidity value EIt is calculated according to the following formula:

$$EIt(kgf\cdot mm^2)=F\times L^3/48H$$

wherein, F is a maximum load (kgf); L is a distance between the support points (mm); and H is the amount of deflection (mm). In the measurement, the maximum load F is 20 kgf, and the distance L between the support points is 200 mm.

Figure 5:
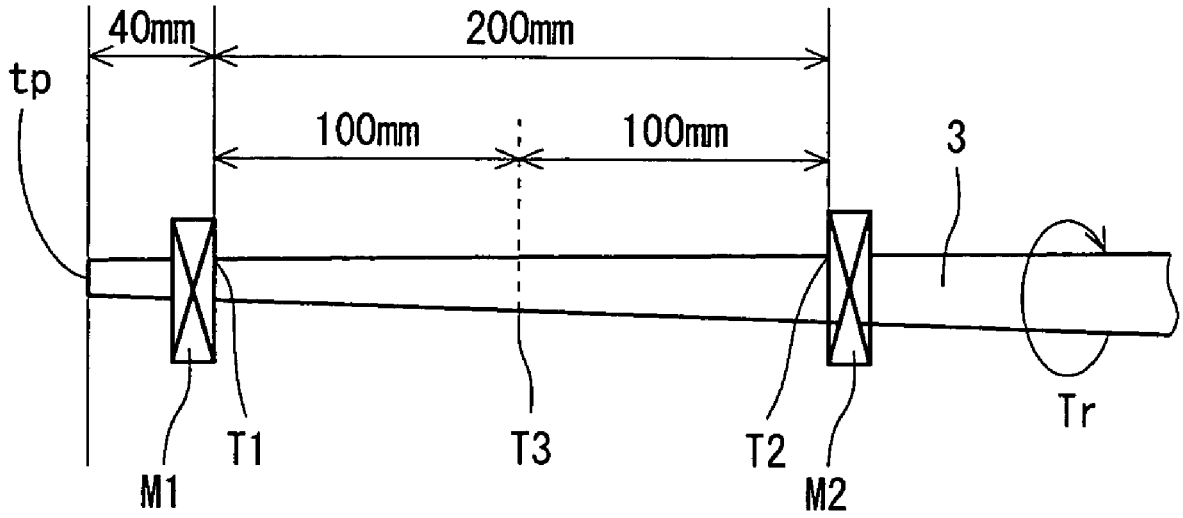
FIG. 5 is a diagram illustrating the mode of measurement of the torsional rigidity value GIt.

In the shaft 3, when a torsional rigidity value of the shaft at a position 140 mm away from the tip on the head side is specified as GIt (kgf·mm$^2$), a ratio of the torsional rigidity value GIt to the aforementioned flexural rigidity value EIt (GIt/EIt) is specified to be $0.8\times10^{-2}$ or greater and $1.2\times10^{-2}$ or less. FIG. 5 shows a method of the measurement of the torsional rigidity value GIt. A position 40 mm away from the tip on the head side tp of the shaft 3 is fixed with a first jig M1, and a position 200 mm away from this first jig M1 is held with a second jig M2. Then the angle of twist A (°) of the shaft when a torque Tr of 139 (kgf·mm) [136.3 (N·cm)] is applied to this second jig M2 is measured. The torsional rigidity value GIt is calculated according to the following formula:

$$GIt(kgf\cdot mm^2)=M\times Tr/A$$

wherein, M represents a measurement span (mm); Tr represents a torque (kgf·mm); and A represents an angle of twist (°). The measurement span M is 200 mm, and the torque Tr is 139 (kgf·mm).

In general, the shaft tip portion spanning from the tip on the head side to approximately 40 mm away therefrom is inserted within a shaft hole 11. Because either bowing or twisting is not substantially caused in the portion inserted into the shaft hole, this portion hardly affects the shaft behavior during the swing. As described above, measurement of the flexural rigidity value EIt and the torsional rigidity value GIt requires a measurement span with a predetermined length. The measurement position of the flexural rigidity value EIt and the torsional rigidity value GIt was selected at the position 140 mm away from the tip on the head side because this position is close to the tip on the head side as long as the portion inserted in the shaft hole is excluded and the measurement is permitted. The flexural rigidity and the torsional rigidity at a position close to the tip on the head side greatly affect the head behavior.

Advantageous effects exerted by the golf club 1 will be explained.

Figure 6A:
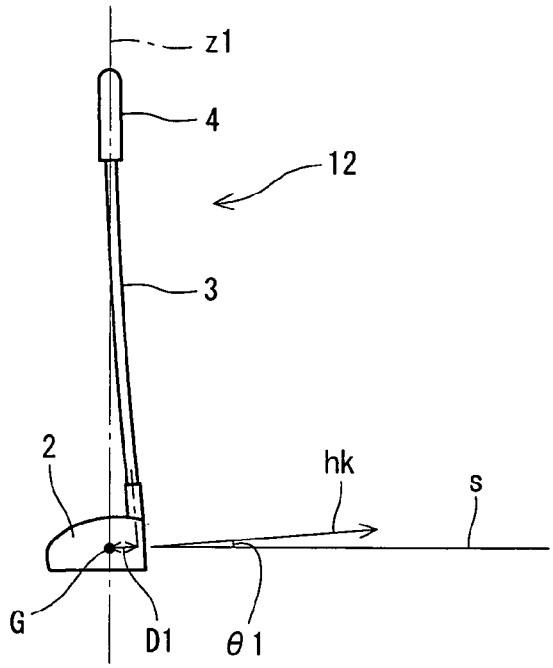
FIG. 6A is a diagram for illustrating an upper blow effect.
Figure 6B:
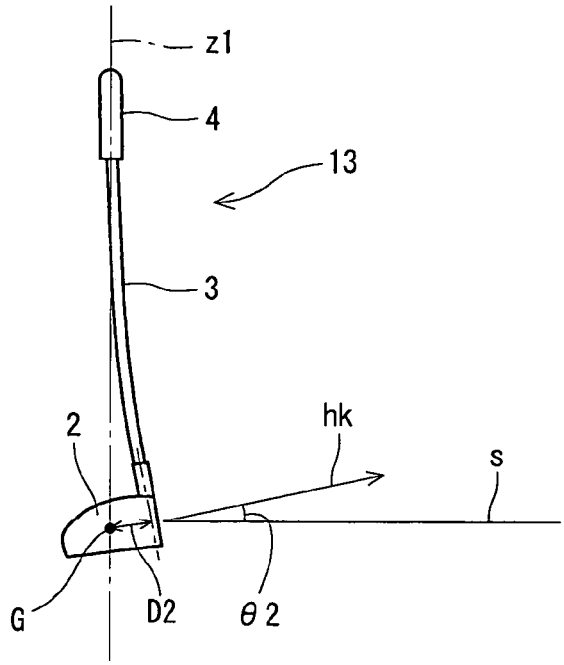
FIG. 6B is a diagram for illustrating an upper blow effect.

As shown in FIG. 6A and FIG. 6B, due to the centrifugal force during the swing, the center of gravity of the head G is apt to be positioned on an extended shaft line z1 that is an extended line of a shaft axis line z in the vicinity of the grip 4. The aptness of the center of gravity of the head G to be positioned on the extended shaft line z1 results in bending of the shaft 3 in a direction of the swing (ahead in a direction of the down swing). In other words, the aptness of the center of gravity of the head G to be positioned on the extended shaft line z1 results in bending of the shaft 3 such that the effective loft angle of the head is increased. As is seen from the comparison of FIG. 6A with FIG. 6B, greater depth of the center of gravity D exerts a greater effect to apt to result in the head trajectory hk of an upper blow in the vicinity of the impact position (hereinafter, also referred to as upper blow effect). The depth of the center of gravity D2 of the golf club 13 shown in FIG. 6B is greater than the depth of the center of gravity D1 of a golf club 12 shown in FIG. 6A. When the angle formed by the intersection of the head trajectory hk of the golf club 13 with the horizontal line s is designated as θ2, and the angle formed by the intersection of the head trajectory hk of the golf club 12 with the horizontal line s is designated as θ1, a relationship of θ2>θ1 tends to be found.

For reference, in the golf club 1 in a static state, the shaft axis line z and the extended shaft line z1 are identical because the shaft 3 is not bent.

By specifying the flexural rigidity value EIt to be equal to or less than $1.75\times10^6$ (kgf·mm$^2$), the tip part of the shaft 3 becomes flexible, thereby achieving the aforementioned upper blow effect sufficiently. When the head trajectory of an upper blow is attained, initial conditions with a great launch angle and a low back spin rate can be readily achieved. Also, when the flexural rigidity value EIt is specified to be equal to or less than $1.75\times10^6$ (kgf·mm$^2$), run of the head 2 is facilitated, and thus, the golf club 1 can be readily handled by many golf players including average handicappers.

When the flexural rigidity of the tip part of the shaft is excessively low, state of deformation of the shaft becomes hardly unstable due to variation of the swing and the like. Accordingly, directional stability and control performances are deteriorated. By specifying the flexural rigidity value EIt to be equal to or greater than $0.5\times10^6$ (kgf·mm$^2$), the flexural rigidity of the tip part of the shaft 3 is secured to be not lower than a given level. Consequently, directional stability and control performances upon hitting may be achieved.

When the flexural rigidity of the tip part of the shaft becomes excessively great, too low deflection of the shaft may be provided. Accordingly, effect of increasing the head speed by way of restoration of the deflection is hardly achieved. Also, when the deflection of the shaft is excessively low, it becomes hard for the golf players to feel the head weight, and thus, decision on the timing of the swing may be difficult. By specifying the flexural rigidity value EIt to be equal to or less than $1.75\times10^6$ (kgf·mm$^2$), the effect of increasing the head speed is readily achieved, and thus, the timing of the swing may be readily decided.

Figure 7:
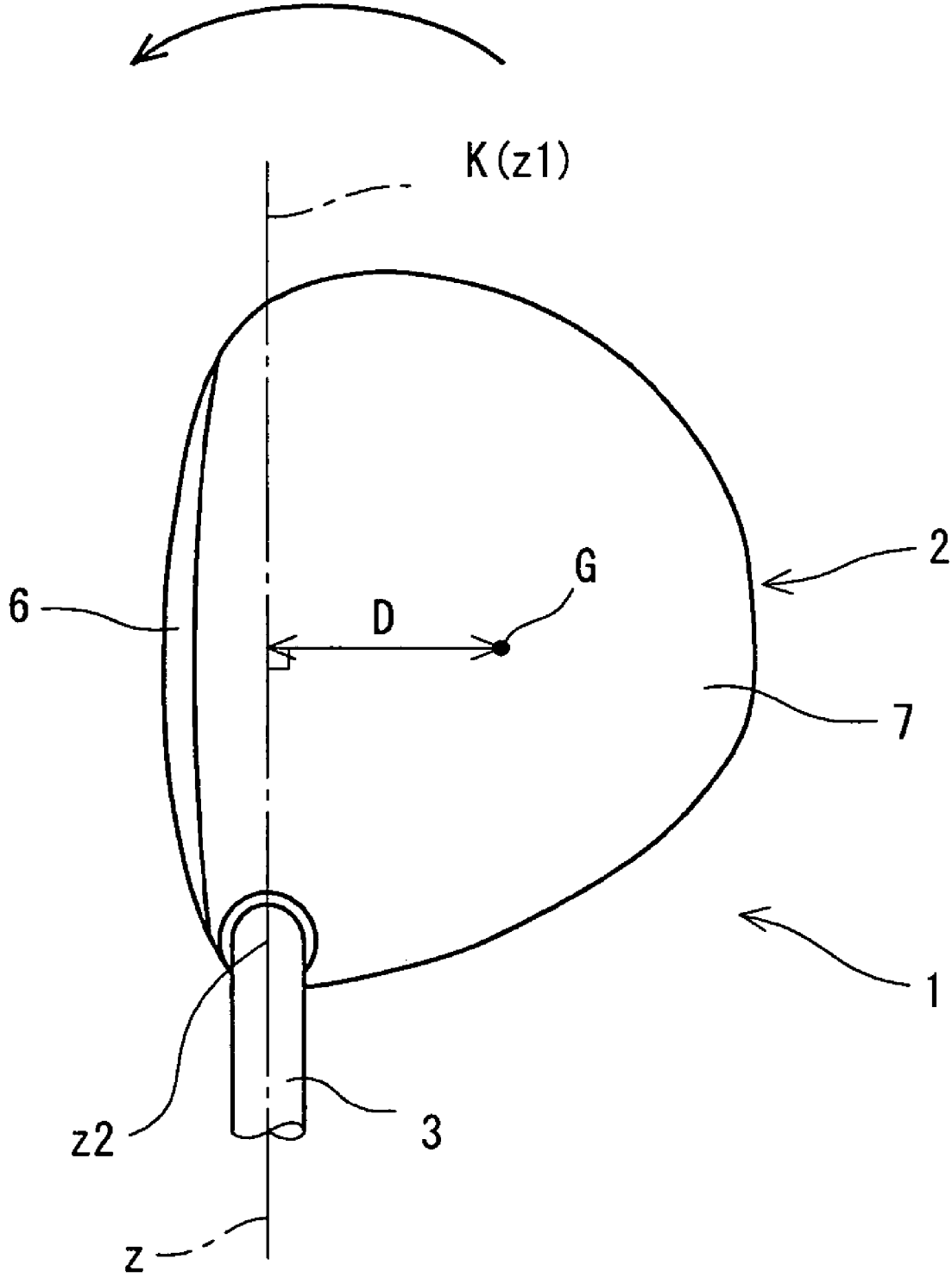
FIG. 7 is an overhead view illustrating the golf club shown in FIG. 1.

FIG. 7 perspectively shows the center of gravity of the head G located inside of the head 2. The center of gravity of the head G is located on the back side of the head from the reference plane K, and is located on the toe side from an axis line z2 of the shaft hole 11. As described above, due to centrifugal force during the swing, the center of gravity of the head G is apt to be positioned on the extended shaft line z1. The centrifugal force during the swing causes the following (1) to (3) events.

(1) As is shown in FIG. 6A and FIG. 6B, the shaft 3 bends toward a swing direction (ahead in the down swing direction), thereby causing the aforementioned upper blow effect.

(2) Because the center of gravity of the head G located on the back side of the head from the reference plane K is apt to be positioned on the extended shaft line z1, the head 2 is apt to rotate so that it returns back. In other words, the head 2 is apt to rotate in a direction that allows the face surface to close (direction indicated by an arrowhead in FIG. 7) (hereinafter, also referred to as face close effect).

(3) Because the center of gravity of the head G located on the toe side from the axis line z2 of the shaft hole 11 is apt to be positioned on the extended shaft line z1, a toe down phenomenon, which is generally referred to, is caused.

The aforementioned face close effect in the above paragraph (2) is generally explained in terms of an effect exerted by angle of centroid of the head. As the angle of centroid is greater, greater face close effect may be achieved.

When a plane including the shaft axis line and the center of gravity of the head is designated as P1, and when a straight line that is parallel to the face surface and is perpendicular to the shaft axis line is designated as L1, the angle of centroid refers to an angle formed by the intersection of the plane P1 with the straight line L1. In case of the face surface being curved, the straight line L1 may be defined as follows. When a plane that is perpendicular to a straight line connecting the center of gravity of the head with the sweet spot is designated as P2, a straight line that is parallel to the plane P2 and is perpendicular to the shaft axis line may correspond to the straight line L1.

In addition, twisting behaviors other than the events described in the above paragraphs (1) to (3) are caused in the shaft 3 during the swing. Because the center of gravity of the head G is located on the toe side from the shaft axis line z, the head 2 is apt to rotate in a direction that allows the face to open by the inertia of the head 2 in the initial stage of the swing. Hence, the shaft is twisted in a direction that allows the face to open in the initial stage of the swing. Next, due to the counteraction caused by the twisting in a direction that allows the face to open, the twist of the shaft returns back, and the head rotates in a direction that allows the face to close. Because the head rotates in a direction that allows the face to close, opening of the face may be suppressed, thereby readily providing a square face upon impact. The event to cause the twisting of the shaft in a direction that allows the face to open in the initial stage of the swing, and thereafter the twist of the shaft returns back due to the counteraction thereby closing the face is also referred to as "shaft torsion vibration" herein below. When the shaft torsion vibration is too small, less counteraction of the twist of the shaft is generated, resulting in tendency of the face to open upon impact. High handicappers often have the skill to provide a square face by orientating the face through using cocking of the wrist. However, because general average handicappers do not have the skill to eliminate the face opening which results from less shaft torsion vibration, the impact is readily brought while the face remaining open.

In the golf club 1, the depth of the center of gravity D is specified to be 20 mm to 30 mm on the following reasons. By specifying the depth of the center of gravity D to be equal to or greater than 20 mm, sufficient upper blow effect is achieved. Also, by specifying the depth of the center of gravity D to be equal to or greater than 20 mm, sufficient face close effect is achieved, and suppression of a sliced ball shot is accomplished. Therefore, the depth of the center of gravity D is more preferably equal to or greater than 22 mm. By specifying the depth of the center of gravity D to be equal to or less than 30 mm, suppression of a hooked ball shot resulting from the excessive face close effect is accomplished. Also, by specifying the depth of the center of gravity D to be equal to or less than 30 mm, flying up of the hit ball which is caused associated with excessive increase in the effective loft upon impact (impact loft) can be suppressed. Accordingly, the depth of the center of gravity D is more preferably equal to or less than 28 mm.

In general, when the torsional rigidity value GIt is too small, it becomes difficult to stabilize the direction of the face, thereby deteriorating directionality of the hit ball. When the torsional rigidity value GIt is too great, the face close effect is excessively suppressed, thereby elevating the frequency of providing sliced balls. The sliced ball results in the reduction of the travel distance. In the present invention, the torsional rigidity value GIt is preferably equal to or greater than $0.5\times10^4$ (kgf·mm$^2$). By specifying the value to be equal to or greater than $0.5\times10^4$ (kgf·mm$^2$), directionality of the hit ball is even more improved. The torsional rigidity value GIt is more preferably equal to or less than $2.0\times10^4$ (kgf·mm$^2$). By specifying the value to be equal to or less than $2.0\times10^4$ (kgf·mm$^2$), the face close effect is sufficiently achieved, and suppression of a sliced ball shot is accomplished. The suppression of sliced ball shots contributes to lengthening of the travel distance. Also, by specifying the torsional rigidity value GIt to be equal to or less than $2.0\times10^4$ (kgf·mm$^2$), the shaft torsion vibration is sufficiently secured. Occurrence of sufficient shaft torsion vibration can contribute to impacts with a square face and suppression of sliced ball shots.

By specifying the value of (GIt/EIt) to be equal to or greater than $0.8\times10^{-2}$, excessive increase in the flexural rigidity value EIt may be suppressed. Also, by specifying the value of (GIt/EIt) to be equal to or greater than $0.8\times10^{-2}$, the torsional rigidity value GIt can be prevented from becoming too small. Therefore, the value of (GIt/EIt) is more preferably equal to or greater than $1.0\times10^{-2}$.

By specifying the value of (GIt/EIt) to be equal to or less than $1.2\times10^{-2}$, the flexural rigidity value EIt can be prevented from becoming too small. Also, by specifying the value of (GIt/EIt) to be equal to or less than $1.2\times10^{-2}$, the torsional rigidity value GIt can be prevented from becoming too great. Therefore, the value of (GIt/EIt) is more preferably equal to or less than $1.1\times10^{-2}$.

By setting the upper limit and lower limit of the value of (GIt/EIt) appropriately, balance of the flexural rigidity and torsional rigidity may be optimized. By optimizing the balance of the flexural rigidity and torsional rigidity, directional stability, great launch angle and low back spin rate may be achieved.

In conventional golf clubs, the depth of the center of gravity D is out of the range of from 20 mm to 30 mm, or the flexural rigidity value EIt is out of the range of from $0.5\times10^6$ to $1.75\times10^6$ (kgf≠mm$^2$). In conventional golf clubs, the depth of the center of gravity D is less than 20 mm, or the flexural rigidity value EIt is greater than $1.75\times10^6$ (kgf·mm$^2$). Almost of the conventional golf clubs have the depth of the center of gravity D of less than 20 mm and the flexural rigidity value EIt of greater than $1.75\times10^6$ (kgf·mm$^2$). Furthermore, the conventional golf clubs have the depth of the center of gravity D of less than 20 mm, or the value of (GIt/EIt) of less than $0.8\times10^{-2}$.

Because the head has a loft angle, greater depth of the center of gravity D tends to result in greater height H of the sweet spot SS (see, FIG. 3). When the height H of the sweet spot SS is great, probability of positioning of the impact point on the downside of the sweet spot SS (sole side) is increased. When a ball is hit at a point on the downside of the sweet spot SS, low launch angle and great back spin rate are apt to be achieved due to a gear effect (gear effect in an up-and-down direction or a longitudinal direction). Conventionally, for reducing the height H of the sweet spot SS, the depth of the center of gravity D has not increased greater than necessary. For reference, the sweet spot SS is a point at the intersection of a perpendicular line drawn from the center of gravity of the head G toward the face surface with the face surface (see, FIG. 3).

In connection with conventional golf clubs, relationship between the flexural rigidity value EIt and the depth of the center of gravity D was not considered, therefore, the design has not involved the flexural rigidity value EIt being smaller than necessary. Also, taking into consideration of the aspect of strength of the shaft, greater flexural rigidity value EIt is more advantageous. Therefore, conventional golf clubs has involved a great flexural rigidity value EIt in the range not to matter in terms of the feeling.

In conventional golf clubs, both the torsional rigidity value GIt and the flexural rigidity value EIt are small for golf players who hit with a low head speed. Conventionally, it has been believed that shafts which are readily twisted and readily deflected are suited for golf players who hit with a low head speed. In addition, it has been conventionally believed that shafts which are difficult in twisting and difficult in deflecting are suited for golf players who hit with a high head speed. Conventionally, there has existed no technical idea to consider the value of (GIt/EIt).

By specifying the depth of the center of gravity D to be great, the inertia moment of the head 2 becomes so great and the angle of centroid becomes so great that a golf club exhibiting excellent directionality of the hit ball and hardly permitting slicing is provided. However, as described above, the height H of the sweet spot SS is liable to be great when the depth of the center of gravity D is great. When the height H of the sweet spot SS is great, the launch angle is liable to be decreased, and the back spin is liable to be increased. Low launch angle and great back spin rate may reduce the travel distance. In the present invention, the upper blow effect is improved by reducing the flexural rigidity value EIt, and by increasing the depth of the center of gravity D. Owing to the upper blow effect, increase of the launch angle and lowering of the back spin rate can be achieved.

When the depth of the center of gravity D becomes great, the angle of centroid may become excessively great. Excessively great angle of centroid may result in too much closed direction of the face upon impact. Accordingly, directionality of the hit ball is deteriorated, as the case may be. In the present invention, by specifying the value of (GIt/EIt) to be great, excessive torsional deformation at the tip part of the shaft is inhibited. Inhibition of the excessive torsional deformation may improve the directionality of the hit ball.

Structure of the head 2 is not particularly limited. Examples of the structure of the head 2 include two-piece structures in which a face member and a head main body were joined; three-piece structures in which a face member, a crown member and a head main body were joined; four-piece structures in which a face member, a crown member, a hosel member and a head main body were joined; and the like.

Method of manufacturing each member constituting the head 2 is not particularly limited. Examples of this method of the manufacturing which may be employed include casting, forging, press forming and combinations of these methods of the manufacturing. Material constituting the head 2 is not particularly limited, but examples thereof which may be employed include titanium alloys, aluminum alloys, stainless steel, magnesium alloys, CFRPs (carbon fiber reinforced plastics) and combinations of the same. Examples of the method of joining the constituting members which may be employed include welding, adhesion, brazing and diffusion bonding and the like.

The head has a volume of preferably equal to or greater than 360 cc, and more preferably equal to or greater than 380 cc. The volume of the head of equal to or greater than 360 cc facilitates providing a great depth of the center of gravity D. The head has a volume of preferably equal to or less than 500 cc, and more preferably equal to or less than 470 cc. By specifying the volume of the head to be equal to or less than 500 cc, strength of the head and design freedom may be sufficiently secured.

Examples of the procedure which may be employed ad libitum for providing a great depth of the center of gravity D include, e.g., the following (11) to (15) or any combination thereof.

(11) A thick-walled portion is provided at the backside part (backside crown portion, backside sole portion, or side portion) of the head.

(12) A material having a great specific gravity is provided at the backside part of the head.

(13) The weight of the face portion is reduced by making the face portion smaller, or making the face portion thinner.

(14) The specific gravity of the face portion is reduced to be smaller than the specific gravity of the other part.

(15) The length in a face-back direction of the head is elongated.

The shaft is preferably made of a fiber reinforced resin in light of the lightweight properties and design freedom. Examples of the method of manufacturing the shaft which may be employed include a sheet winding manufacturing method, a filament winding manufacturing method, an internally pressurization molding method and the like. Examples of the reinforcing fiber which may be employed in the fiber reinforced resin include carbon fibers, glass fibers, aramid fibers, boron fibers, aromatic polyamide fibers, aromatic polyester fibers, supramacromolecular polyethylene fibers and the like, and the carbon fibers are preferred. Examples of the resin which may be employed include thermosetting resins, thermoplastic resins and the like. In light of the strength and rigidity, thermosetting resins are preferred, and particularly, epoxy based resins are preferred.

Examples of the thermosetting resin which may be employed include epoxy based resins, unsaturated polyester based resins, phenol based resins, melamine based resins, urea based resins, diallyl phthalate based resins, polyurethane based resins, polyimide based resins, silicon resins and the like. Examples of the thermoplastic resin include polyamide resins, saturated polyester based resins, polycarbonate based resins, ABS resins, polyvinyl chloride based resins, polyacetal based resins, polystyrene based resins, polyethylene based resins, polyvinyl acetate based resins, AS resins, methacryl resins, polypropylene resins, fluorocarbon resins and the like.

Figure 8:
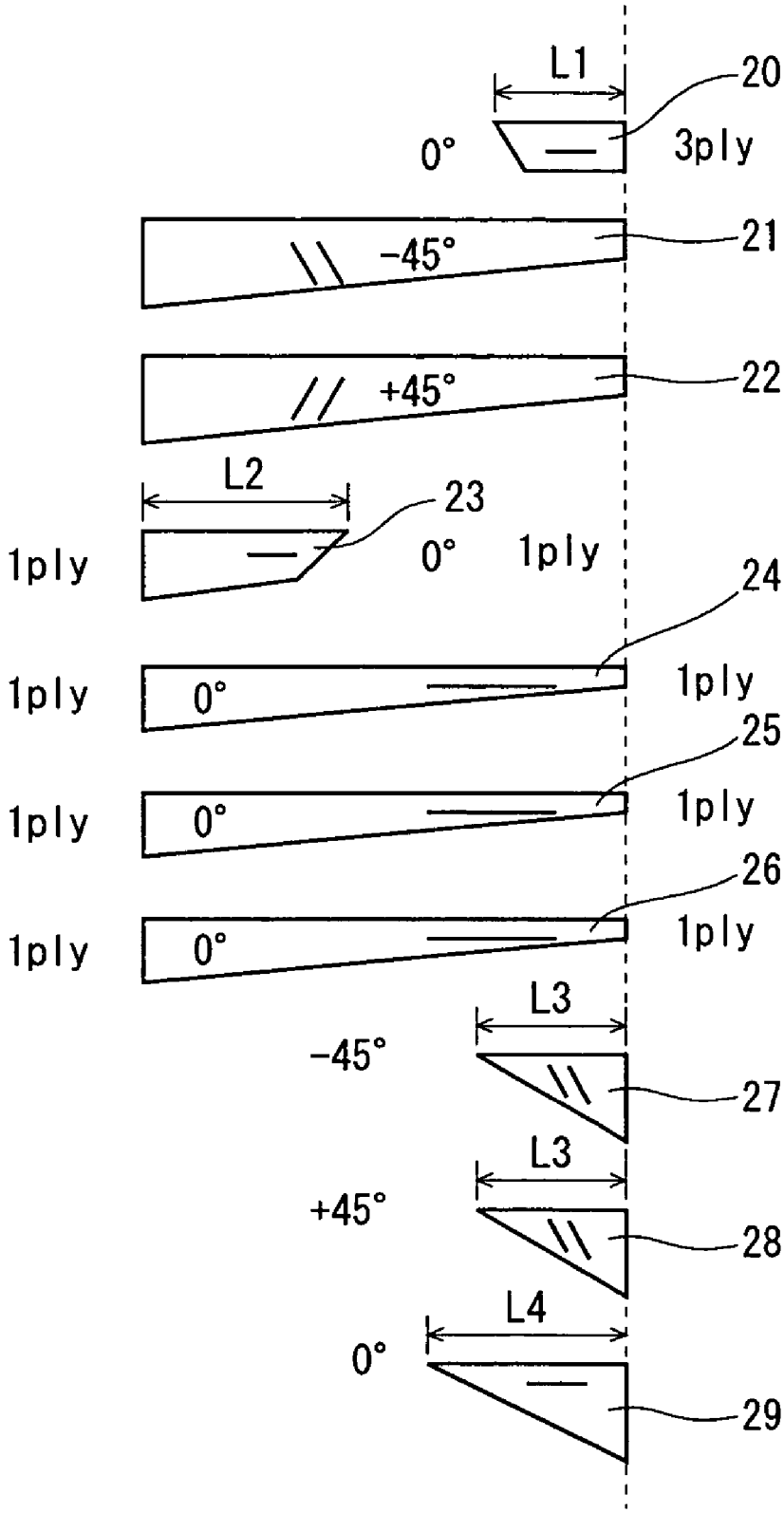
FIG. 8 shows an example of a developed view of a pre-preg construction of shafts which may be employed in the present invention.

FIG. 8 is a development view showing one example of the pre-preg construction of the shaft according to the sheet winding manufacturing method. The right-hand side in FIG. 8 shows the head side (tip side) of the shaft, while the left-hand side shows the grip side (butt side) of the shaft. The pre-preg of 10 sheets are included in total. The pre-preg shown on the upper side in FIG. 8 is disposed on the inner layer side. The pre-preg 20 is for a reinforcing layer of the tip on the head side positioned on the innermost layer. The fiber orientation angle of the pre-preg 20 is substantially 0°. The fiber orientation angle is an angle formed by the intersection of the shaft axis line with the longitudinal direction of the fiber. The pre-pregs 21, 22 are for a bias layer positioned on the entire length of the shaft. The fiber orientation angle of the pre-preg 21 is −45°, and the fiber orientation angle of the pre-preg 22 is +45°. The pre-preg 23 is for a reinforcing layer on the back end that partially reinforces the back end part of the shaft (grip side tip). The fiber orientation angle of the pre-preg 23 is substantially 0°. The pre-pregs 24, 25, 26 are for a straight layer. The fiber orientation angle of the pre-pregs 24, 25, 26 are substantially 0°. The pre-pregs 24, 25, 26 are wound by 1 ply, respectively. The pre-pregs 27 and pre-preg 28 are for a bias layer partially positioned on the shaft tip part. The fiber orientation angle of the pre-preg 27 is −45°, and the fiber orientation angle of the pre-preg 28 is +45°. The pre-preg 29 is for a reinforcing layer of the tip on the head side positioned on the outermost layer. The fiber orientation angle of the pre-preg 29 is substantially 0°.

Specific examples of the procedure which may be employed for providing a great flexural rigidity value EIt include the following (31) to (35).

(31) The tip part on the head side (tip end part) is allowed to have a great external diameter of the shaft.

(32) The fiber modulus of elasticity of the reinforcing layer of the tip on the head side (pre-preg 20 or pre-preg 29 in an embodiment shown in FIG. 8) is elevated.

(33) The resin content (Rc.) of the reinforcing layer of the tip on the head side (pre-preg 20 or pre-preg 29 in the embodiment shown in FIG. 8) is lowered.

(34) The thickness of the pre-preg of the reinforcing layer of the tip on the head side (pre-preg 20 or pre-preg 29 in the embodiment shown in FIG. 8) is increased.

(35) Number of winding (ply number) of the reinforcing layer of the tip on the head side (pre-preg 20 or pre-preg 29 in the embodiment shown in FIG. 8) is increased.

Specific examples of the procedure which may be employed for providing a small flexural rigidity value EIt include the following (36) to (40).

(36) The tip part on the head side (tip end part) is allowed to have a small external diameter of the shaft.

(37) The fiber modulus of elasticity of the reinforcing layer of the tip on the head side (pre-preg 20 or pre-preg 29 in the embodiment shown in FIG. 8) is lowered.

(38) The resin content (Rc.) of the reinforcing layer of the tip on the head side (pre-preg 20 or pre-preg 29 in the embodiment shown in FIG. 8) is elevated.

(39) The thickness of the pre-preg of the reinforcing layer of the tip on the head side (pre-preg 20 or pre-preg 29 in the embodiment shown in FIG. 8) is decreased.

(40) Number of winding (ply number) of the reinforcing layer of the tip on the head side (pre-preg 20 or pre-preg 29 in the embodiment shown in FIG. 8) is decreased.

Specific examples of the procedure which may be employed for providing a great torsional rigidity value GIt include the following (41) to (45).

(41) Number of winding (ply number) of the bias layer (pre-pregs 21, 22 in the embodiment shown in FIG. 8) is increased.

(42) The fiber modulus of elasticity of the bias layer partially positioned on the tip part on the head side (pre-pregs 27, 28 in the embodiment shown in FIG. 8) is elevated.

(43) The resin content of the bias layer partially positioned on the tip part on the head side (pre-pregs 27, 28 in the embodiment shown in FIG. 8) is lowered.

(44) The thickness of the pre-preg of the bias layer partially positioned on the tip part on the head side (pre-pregs 27, 28 in the embodiment shown in FIG. 8) is increased.

(45) Number of winding (ply number) of the bias layer partially positioned on the tip part on the head side (pre-pregs 27, 28 in the embodiment shown in FIG. 8) is increased.

Specific examples of the procedure which may be employed for providing a small torsional rigidity value GIt include the following (46) to (50).

(46) Number of winding (ply number) of the bias layer (pre-pregs 21, 22 in the embodiment shown in FIG. 8) is decreased.

(47) The fiber modulus of elasticity of the bias layer partially positioned on the tip part on the head side (pre-pregs 27, 28 in the embodiment shown in FIG. 8) is lowered.

(48) The resin content of the bias layer partially positioned on the tip part on the head side (pre-pregs 27, 28 in the embodiment shown in FIG. 8) is elevated.

(49) The thickness of the pre-preg of the bias layer partially positioned on the tip part on the head side (pre-pregs 27, 28 in the embodiment shown in FIG. 8) is decreased.

(50) Number of winding (ply number) of the bias layer partially positioned on the tip part on the head side (pre-pregs 27, 28 in the embodiment shown in FIG. 8) is decreased.

Specific examples of the procedure which may be employed for providing a great value of (GIt/EIt) include procedures designed by combining any one of the above (41) to (45) with any one of the above (36) to (40).

Specific examples of the procedure which may be employed for providing a small value of (GIt/EIt) include procedures designed by combining any one of the above (46) to (50) with any one of the above (31) to (35).

EXAMPLES

Hereinafter, advantages of the present invention will be demonstrated by way of Examples, however, the present invention should not be construed to limit the scope thereof based on the disclosure of the Examples.

Example 1

A head had a three-piece structure including a head main body, a face member and a crown member manufactured by casting using 6-4Ti (Ti-6Al-4V). The face member was produced by subjecting a rolled material of 6-4Ti to a milling processing followed by press molding. The face member and the head main body were joined together by plasma welding. The crown member was produced by laminating the pre-preg sheets of CFRP (carbon fiber reinforced plastic) followed by press molding. The head main body was adhered to the crown member using an adhesive. The head had a volume of 420 cc, and a loft angle (real loft angle) of 10°. A recessed part was provided on the backside of the sole, and to this recessed part was injected a heavy load made of a W—Ni alloy. By regulating the weight of the heavy load and the wall thickness of the side portion, the weight at the depth of the center of gravity D was adjusted, and setting of the depth of the center of gravity D as shown in Table 1 below was executed.

The shaft was similar to that according to the embodiment shown in FIG. 8. Any of the used CFRP (carbon fiber reinforced plastic) material constituting the shaft was pre-preg manufactured by Toray Industries, Inc. The used bias layer (pre-pregs 21, 22, 27, 28 shown in FIG. 8) had a fiber type of M40J (tensile modulus of elasticity being 377 Gpa), a resin type of an epoxy resin, and a resin content of 25 wt %. The used straight layer (pre-pregs 20, 23, 24, 25, 26, 29 shown in FIG. 8) had a fiber type of M30S (tensile modulus of elasticity being 294 Gpa), a resin type of an epoxy resin, and a resin content of 25 wt %. The length L1 of the pre-preg 20 in a direction along the shaft axis line (see, FIG. 8) was 200 mm; the length L2 of the pre-preg 23 in a direction along the shaft axis line was 350 mm; the length L3 of the pre-preg 27 and pre-preg 28 in a direction along the shaft axis line was 250 mm; and the length L4 of the pre-preg 29 in a direction along the shaft axis line was 300 mm. The flexural rigidity value EIt and the torsional rigidity value GIt were regulated by altering the fiber modulus of elasticity and the using amount of the pre-preg sheets used for the pre-preg 20, pre-preg 27, pre-preg 28 and pre-preg 29, thereby setting the flexural rigidity value EIt and torsional rigidity value GIt as shown in Table 1 below. These head and shaft were combined with a grip to produce the golf club of Example 1. The club had a length of 45 inch.

Examples 2 to 5

Golf clubs were obtained in a similar manner to Example 1 except that the depth of the center of gravity D, the flexural rigidity value EIt and the torsional rigidity value GIt were as shown in Table 1.

Comparative Examples 1 to 4

Golf clubs were obtained in a similar manner to Example 1 except that the depth of the center of gravity D, the flexural rigidity value EIt and the torsional rigidity value GIt were as shown in Table 1.

[Evaluation]

Ten 5-to-20 handicappers evaluated each golf club by hitting balls therewith in effect. Each handicapper hit 6 balls with each golf club while excluding the hitting clearly believed to be a mishitting. Launch angle, back spin rate, travel distance (total of the flight distance and run) of the hit balls were measured. Data on the launch angle, back spin rate and travel distance are average values for all the balls hit by the ten handicappers. Evaluation on the directionality was made by aggregating the variation in the crosswise direction for each handicapper, and averaging the variation in the crosswise direction for the ten handicappers. The variation in the crosswise direction means a distance in the crosswise direction between the rightmost position and the leftmost position where the 6 balls, which were hit by each handicapper taking aim at the target, reached. Specifications and evaluation results of each golf club are shown in Table 1.

TABLE 1

Specifications and Evaluation Results of Examples 1 to 5 and Comparative Examples 1 to 4

| | Unit | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|
| Depth of center of gravity D | mm | 25 | 25 | 25 | 20 | 30 | 25 | 25 | 15 | 35 |
| Flexural rigidity value EIt | $\times 10^6$ kgf · mm$^2$ | 1.25 | 1.70 | 0.60 | 1.25 | 1.25 | 1.80 | 0.40 | 1.25 | 1.25 |
| Torsional rigidity value GIt | $\times 10^4$ kgf · mm$^2$ | 1.25 | 1.40 | 0.70 | 1.25 | 1.25 | 1.25 | 0.60 | 1.25 | 1.25 |
| (GIt/EIt) | $\times 10^{-2}$ | 1.00 | 0.82 | 1.17 | 1.00 | 1.00 | 0.69 | 1.50 | 1.00 | 1.00 |
| Launch angle | deg | 14.9 | 14.3 | 15.2 | 14.1 | 15.6 | 14.0 | 15.5 | 13.5 | 16.2 |
| Back spin rate | rpm | 2230 | 2280 | 2250 | 2160 | 2390 | 2360 | 2300 | 2050 | 2620 |
| Travel distance | yard | 242 | 236 | 243 | 233 | 239 | 227 | 240 | 224 | 229 |
| Evaluation on directionality | yard | 30.5 | 28.6 | 38.9 | 29.2 | 31.2 | 30.2 | 54.1 | 28.8 | 36.7 |

As shown in Table 1, taken all the evaluation items together, Examples 1 to 5 achieved more advantageous results than Comparative Examples 1 to 4. In Comparative Example 1, the great flexural rigidity value EIt was so high that less travel distance was attained, in particular. In Comparative Example 2, the torsional rigidity value GIt and the flexural rigidity value EIt were so low that inferior directionality was attained, in particular. In Comparative Example 3, the depth of the center of gravity D was so small that less travel distance was attained, in particular. In Comparative Example 4, the depth of the center of gravity D was so great that the ball flied up leading to less travel distance.

The foregoing descriptions are merely for illustrative examples, and various modifications can be made without departing from the principles of the present invention.

What is claimed is:

1. A golf club, in a reference state in which the golf club is placed on a horizontal plane with a predetermined lie angle and face angle, and the shaft axis line thereof is disposed within a reference plane that is perpendicular to the horizontal plane, the golf club having: a center of gravity of the head being positioned on the back side of the head from the reference plane, and a depth of the center of gravity that is a distance between the reference plane and the center of gravity of the head being 20 mm or greater and 30 mm or less;

a flexural rigidity value EIt (kgf·mm$^2$) of the shaft at a position 140 mm away from the tip on the head side being $0.5\times10^6$ or greater and $1.75\times10^6$ or less; and a value of a ratio of a torsional rigidity value GIt to the flexural rigidity value EIt (GIt/EIt) being $0.8\times10^{-2}$ or greater and $1.2\times10^{-2}$ or less as determined when the torsional rigidity value of the shaft at a position 140 mm away from the tip on the head side is defined as GIt (kgf·mm$^2$).

* * * * *